US012385186B2

(12) United States Patent
Wang et al.

(10) Patent No.: US 12,385,186 B2
(45) Date of Patent: Aug. 12, 2025

(54) PAPER-BASED ELECTROMAGNETIC SHIELDING COMPOSITE WITH FLAME RETARDANT PROPERTIES AND ITS PREPARATION METHOD AND APPLICATION

(71) Applicants: Jiangsu Aoshen Hi-tech Materials Co., ltd., Lianyungang (CN); Jiangnan University, Wuxi (CN)

(72) Inventors: Shihua Wang, Lianyungang (CN); Zhu Long, Wuxi (CN); Mingdong Tao, Lianyungang (CN); Ruqiang Zhang, Wuxi (CN); Tao Guo, Lianyungang (CN); Yongzhen Zhan, Lianyungang (CN); Xinglong Tang, Lianyungang (CN); Ling Miao, Lianyungang (CN); Chang Sun, Wuxi (CN)

(73) Assignees: Jiangsu Aoshen Hi-tech Materials Co., ltd., Lianyungang (CN); Jiangnan University, Wuxi (CN)

( * ) Notice: Subject to any disclaimer, the term of this patent is extended or adjusted under 35 U.S.C. 154(b) by 259 days.

(21) Appl. No.: 18/325,406

(22) Filed: May 30, 2023

(65) Prior Publication Data

US 2023/0304224 A1 Sep. 28, 2023

Related U.S. Application Data

(63) Continuation of application No. PCT/CN2022/128093, filed on Oct. 28, 2022.

(30) Foreign Application Priority Data

Nov. 30, 2021 (CN) ..... 202111442124.1

(51) Int. Cl.
*D21H 19/24* (2006.01)
*D21H 13/26* (2006.01)
(Continued)

(52) U.S. Cl.
CPC ..... *D21H 19/24* (2013.01); *D21H 13/26* (2013.01); *D21H 17/14* (2013.01); *D21H 19/84* (2013.01); *D21H 21/34* (2013.01); *D21H 27/00* (2013.01)

(58) Field of Classification Search
CPC ..... D21H 19/24; D21H 13/26; D21H 17/14; D21H 27/00
(Continued)

(56) References Cited

U.S. PATENT DOCUMENTS

2009/0107842 A1* 4/2009 Park ..... D01D 5/0038 204/554
2015/0255802 A1* 9/2015 Kim ..... H01M 4/926 429/524
2019/0290170 A1* 9/2019 Chen ..... C23C 18/30

FOREIGN PATENT DOCUMENTS

CN 106120458 A 11/2016
CN 108794790 A 11/2018
(Continued)

*Primary Examiner* — Jacob T Minskey
(74) *Attorney, Agent, or Firm* — IPRO, PLLC

(57) ABSTRACT

Disclosed are a paper-based electromagnetic shielding composite with flame retardant properties and its preparation method and application, belonging to the technical field of electromagnetic shielding. In the present disclosure, PI fibers are modified by polydopamine and grafted with carbon nanotubes, polyimide fiber paper is prepared by a wet papermaking technology, an in-situ synthesis method is used to enable conductive MOFs and polymer PPy to grow on the fiber paper, and finally polyimide resin is sprayed onto the paper to prepare the paper-based electromagnetic shielding composite with flame retardant properties. The method is simple in process without complex synthesis equipment, and solves the problems that polyimide fiber paper is poor in paper forming property and paper mechanical property, and carbon nanotubes are easy to agglomerate in paper and
(Continued)

limited in addition amount in the prior art. The paper-based composite has good mechanical property, heat resistance, flame retardancy and electromagnetic shielding performance.

7 Claims, 3 Drawing Sheets

(51) Int. Cl.
*D21H 17/14* (2006.01)
*D21H 19/84* (2006.01)
*D21H 21/34* (2006.01)
*D21H 27/00* (2006.01)

(58) Field of Classification Search
USPC ..... 162/135
See application file for complete search history.

(56) References Cited

FOREIGN PATENT DOCUMENTS

| | | | |
|---|---|---|---|
| CN | 112359595 | A | 2/2021 |
| JP | 2013082610 | A | 5/2013 |

* cited by examiner

PAPER-BASED ELECTROMAGNETIC SHIELDING COMPOSITE WITH FLAME RETARDANT PROPERTIES AND ITS PREPARATION METHOD AND APPLICATION

TECHNICAL FIELD

The present disclosure relates to a paper-based electromagnetic shielding composite with flame retardant properties and its preparation method and application, belonging to the technical field of electromagnetic shielding.

BACKGROUND

With the advent of the era of artificial intelligence, the extensive use of various electronic and electrical equipment makes electromagnetic shielding materials have relatively great application prospects. Especially in the fields such as aerospace, high-speed trains, and automobile industry, the requirements for the electromagnetic shielding materials are getting higher and higher. It tends to enable the electromagnetic shielding materials to provide electromagnetic wave protection and have the properties such as light weight, flexibility, high-temperature resistance, and flame retardancy. However, a paper-based material, as an integrated material of structure and function, has the characteristics of being lightweight, flexible, easy to process, and the like. The material can be processed appropriately to prepare high-performance paper-based electromagnetic shielding materials, thus meeting the current demand for the high-performance electromagnetic shielding materials.

High-performance polyimide (PI) fibers have good temperature resistance, higher mechanical properties, and good self-extinguishment, so that a new raw material is provided for the preparation of high-performance paper-based electromagnetic shielding materials. However, because the high-performance PI fibers are chemical synthetic fibers and have smooth surfaces, the bonding strength between fibers and between the fibers and pulp is relatively poor in a papermaking process. As a result, there is currently no commercialized paper-based PI fiber composite in the domestic market (Hot Spots and Prospects of Technological Innovation of Paper-based Functional Materials [J]. Zhang Meiyun. China Pulp & Paper Industry, 2021, 42(01):16-20). Therefore, in order to overcome the defects of existing PI fiber materials, meet the current demand for high-performance fiber paper-based electromagnetic shielding materials, and break the technological monopoly of the high-performance fiber paper-based electromagnetic shielding materials abroad, it is urgently needed to provide a method for preparing a high-performance fiber paper-based electromagnetic shielding composite.

SUMMARY

The technical problem to be solved by the present disclosure is to provide a method for preparing a paper-based electromagnetic shielding composite with flame retardant properties. The paper-based electromagnetic shielding composite with flame retardant properties obtained by the method not only has good flame retardancy, thermal stability, and mechanical properties, but also has good electromagnetic shielding performance.

Another technical problem to be solved by the present disclosure is to provide a method for preparing a paper-based electromagnetic shielding composite with flame retardant properties so as to overcome the problems of poor paper-forming performance of PI fibers, easy agglomeration of wave-absorbing fillers in a papermaking process, and the like, which is simple, easy to operate, low in cost, and suitable for industrial mass production.

The objective of the present disclosure is achieved by the following technical solution: a method for preparing a paper-based electromagnetic shielding composite with flame retardant properties, which includes the following steps:

(1) dispersing polyimide fibers (PI fibers) in water, adding dopamine hydrochloride and tris(hydroxymethyl) aminomethane to react, and then adding carbon nanotubes to continue the reaction; after the reaction is finished, filtering and collecting solids, washing, and drying to obtain carbon nanotube-modified PI fibers, denoted as carbon nanotube/PI fibers;

(2) dispersing the carbon nanotube-modified PI fibers and PPTA pulp in water, mixing well, and then using a wet papermaking process to make sheets; after that, pressing and drying to obtain carbon nanotube/PI fiber paper;

(3) dispersing a nickel source, a cobalt source and 2, 3, 6, 7, 10, 11-hexahydroxytriphenylene in water, then adding the obtained carbon nanotube/PI fiber paper, and carrying out a reaction at 70-100° C.; after the reaction is finished, taking out the carbon nanotube/PI fiber paper, and drying to obtain MOFs-modified carbon nanotube/PI fiber paper, denoted as NiCo-CAT/carbon nanotube/PI fiber paper; and (4) spraying one side of the obtained NiCo-CAT/carbon nanotube/PI fiber paper with a pyrrole solution and making same stand still for a reaction; and after the reaction is finished, spraying a polyimide resin solution onto the other side of the NiCo-CAT/carbon nanotube/PI fiber paper, and then performing hot-pressing treatment to obtain the paper-based electromagnetic shielding composite with flame retardant properties.

In one embodiment of the present disclosure, in step (1), the mass ratio of the dopamine hydrochloride to the tris (hydroxymethyl) aminomethane to the carbon nanotubes to the PI fibers to the water is (2-6):(3-6):(0.1-0.5):3:1000, respectively.

In one embodiment of the present disclosure, in step (1), the mass ratio of the carbon nanotubes to the dopamine hydrochloride to the PI fibers is (0.5-2):(5-10):15. Specifically, 2:10:15 is preferred.

In one embodiment of the present disclosure, in step (1), the polyimide fibers (PI fibers) are dispersed in water, the dopamine hydrochloride and the tris(hydroxymethyl) aminomethane are added to react for 3-8 h, and then the carbon nanotubes are added to continue the reaction for 10-15 h.

In one embodiment of the present disclosure, the drying temperature in step (1) is 100-110° C.

In one embodiment of the present disclosure, in step (1), the basis weight of the carbon nanotube/PI fiber paper is 60 g/cm$^2$.

In one embodiment of the present disclosure, in step (2), the mass ratio of the carbon nanotube-modified PI fibers to the PPTA pulp is (6-8):(2-4).

In one embodiment of the present disclosure, the pressing pressure in step (2) is 0.3-0.5 Mpa.

In one embodiment of the present disclosure, in step (2), the drying temperature after pressing is 100-120° C.

In one embodiment of the present disclosure, in step (3), the mass ratio of nickel acetate to cobalt acetate to the 2, 3, 6, 7, 10, 11-hexahydroxytriphenylene to the water is (0.5-1.0):(0.05-0.2):(8-12):400.

In one embodiment of the present disclosure, in step (3), the mass ratio of the 2, 3, 6, 7, 10, 11-hexahydroxytriphenylene to the dopamine hydrochloride to the carbon nanotube/PI fiber paper is 1:(20-50):12. Specifically, 1:40:12 is preferred.

In one embodiment of the present disclosure, in step (3), the reaction time is 6-12 h.

In one embodiment of the present disclosure, in step (3), the drying temperature is 100-110° C.

In one embodiment of the present disclosure, in step (4), the concentration of the pyrrole aqueous solution is 10-30 g/L.

In one embodiment of the present disclosure, in step (4), the mass ratio of pyrrole to NiCo-CAT/carbon nanotube/PI fiber paper is (1-3):15. Specifically, 2:15 is preferred.

In one embodiment of the present disclosure, in step (4), the time for standing still for a reaction is 4-12 h, and the temperature is room temperature.

In one embodiment of the present disclosure, in step (4), a solvent of the polyimide resin solution is N' N dimethylacetamide.

In one embodiment of the present disclosure, in step (4), the concentration of the polyimide resin solution is 50-150 g/L, and further preferably 60-120 g/L. Specifically, 100 g/L is preferred.

In one embodiment of the present disclosure, the mass ratio of the polyimide resin to the NiCo-CAT/carbon nanotube/PI fiber paper is (3-6):6. Specifically, 5:6 is preferred.

In one embodiment of the present disclosure, in step (4), the parameters of the hot-pressing treatment are as follows: the temperature is 120-150° C., the pressure is 5-25 MPa, and the time is 2-8 min.

The present disclosure provides a paper-based electromagnetic shielding composite with flame retardant properties prepared on the basis of the above method.

The present disclosure also provides application of the paper-based electromagnetic shielding composite with flame retardant properties in the fields of electromagnetic shielding, electrical conduction and flame retardancy.

Beneficial Effects of the Present Disclosure (1) According to the present disclosure, the paper-based electromagnetic shielding composite with flame retardant properties is obtained by modifying the PI fibers with polydopamine and grafting same with the carbon nanotubes, which greatly overcomes the surface inertness of the PI fibers, and avoids the influence of the conventional packing method for carbon nanotubes on paper-based materials.

(2) The paper-based electromagnetic shielding composite with flame retardant properties provided by the present disclosure is prepared through the conventional wet papermaking technology and in-situ synthesis method, which are simple in process, low in cost, high in production efficiency, and suitable for industrial production.

(3) According to the present disclosure, the obtained paper-based electromagnetic shielding composite with flame retardant properties has a higher specific surface area due to the introduction of the conductive NiCo-CAT material, which is beneficial to the absorption of electromagnetic waves.

(4) According to the present disclosure, the obtained paper-based electromagnetic shielding composite with flame retardant properties is good in high heat resistance and electromagnetic shielding performance. The temperature resistance and self-extinguishment of polyimide endow the paper-based electromagnetic shielding composite with good flame retardancy.

DETAILED DESCRIPTION

Figure 1A:
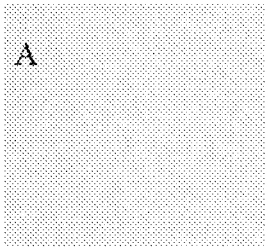
FIG. 1A shows a physical diagram of PI fiber base paper.
Figure 1B:
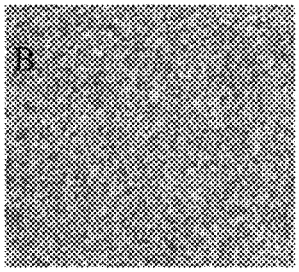
FIG. 1B is a physical diagram of carbon nanotube/PI fiber paper in Example 1.
Figure 1C:
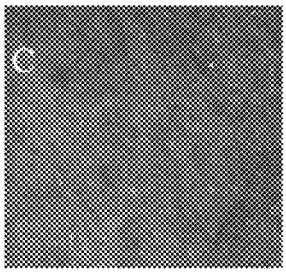
FIG. 1C is a physical diagram of a paper-based electromagnetic shielding composite with flame retardant properties in Example 1.
Figure 2:
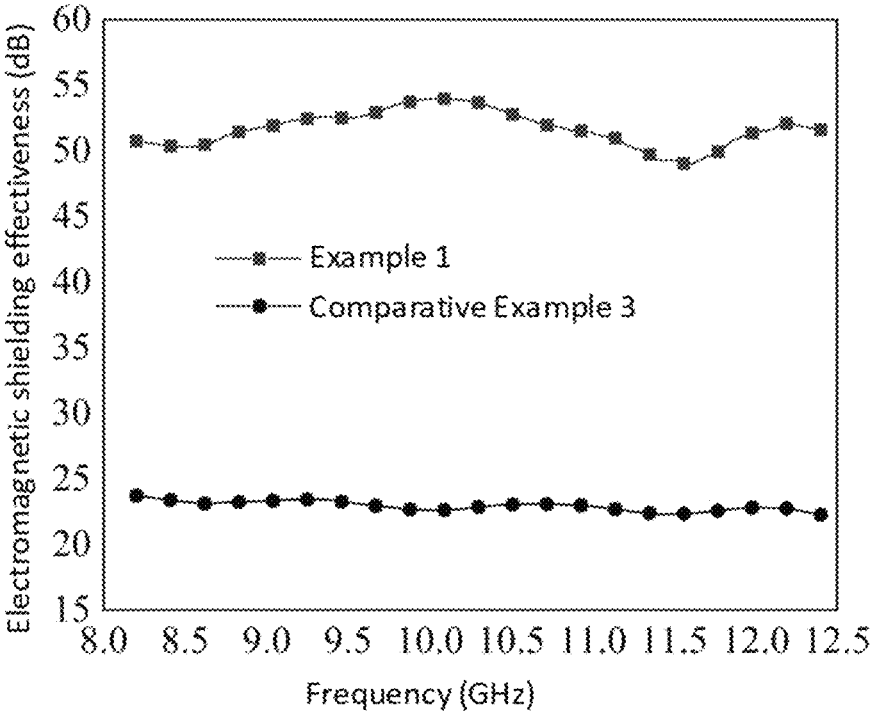
FIG. 2 is a graph showing the electromagnetic shielding performances of paper-based electromagnetic shielding composites obtained in Example 1 and Comparative Example 3.
Figure 3:
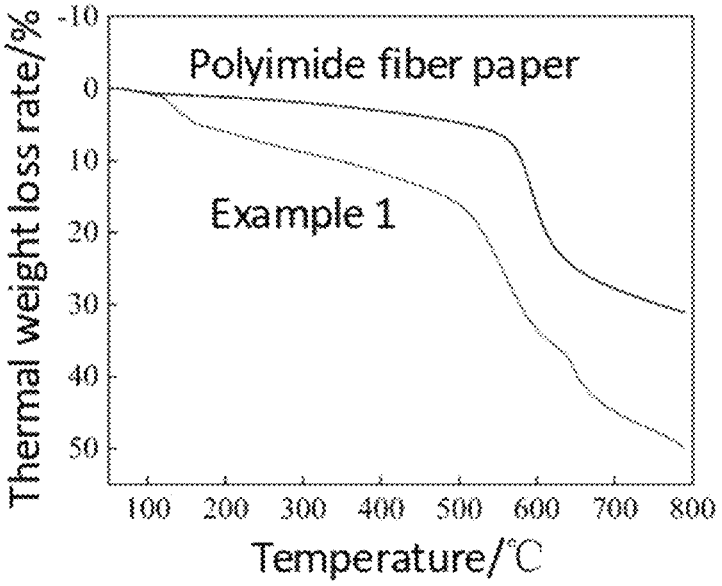
FIG. 3 shows a thermal performance test of the paper-based electromagnetic shielding composite with flame retardant properties obtained in Example 1.

Exemplary examples of the present disclosure are described below, and it should be understood that the examples are used for the purpose of better illustrating the present disclosure and are not intended to limit the present disclosure.

The polyimide fibers involved in the present disclosure were purchased from Jiangsu Aoshen Hi-tech Materials Co., Ltd. (Methyl-nylon Suplon®, with lengths of 3 mm).

The polyimide resin involved in the present disclosure was purchased from Hangzhou Surmount Science & Technology Co., Ltd. (SG120L).

The carbon nanotubes involved in the present disclosure were purchased from Jiangsu Tanfeng Graphene Technology Co., Ltd. (008-4H, with lengths of 10-20 am).

The PPTA pulp involved in the present disclosure was purchased from Shenzhen Xiangu High-Tech. Co., Ltd., with a moisture content of 84.2% and a beating degree of 27° SR, 0.3 to 0.6 mm.

Testing Method:

1. Tensile Strength

According to the national standard (GB/T 453-2002), a universal material testing machine was used to stretch a sample with a specified size to fracture under constant speed loading conditions, and the sample was tested for a plurality of times to obtain an average value, so as to obtain the tensile strength of the sample.

2. Conductivity Test

The electrical conductivity of electromagnetic shielding paper was tested by an ST2263-four-probe tester.

3. Electromagnetic Shielding Performance Test

A vector network analyzer E5061A was used to measure the shielding effect of the electromagnetic shielding paper on electromagnetic waves by a waveguide method.

4. Thermal Stability Test

A thermal gravimetric analyzer Q500 was used to test the temperature index of the sample at 10% thermal weight loss to characterize the thermal stability of the electromagnetic shielding paper.

5. Flame Retardant Rating Test

The sample was tested for flame retardancy by using a British FTT0082 vertical burner for two 10-second combustion tests.

Example 1

3.0 g of PI fibers (3 mm, purchased from Jiangsu Aoshen Hi-tech Materials Co., Ltd.) were evenly dispersed in water, and 2.0 g of dopamine hydrochloride and 2.4 g of tris (hydroxymethyl) aminomethane were then added to react for 6 h at the room temperature. After the reaction was finished, 0.4 g of carbon nanotubes was added, and stirring was continued to react for 12 h. Finally, the product was filtered, washed, and dried at 105° C., so that carbon nanotube-modified PI fibers were obtained. 1.32 g of the modified PI fibers and 0.56 g of PPTA pulp (purchased from Shenzhen Xiangu High-Tech. Co., Ltd., with a moisture content of 84.2% and a beating degree of 27° SR, 0.3 to 0.6 mm) were evenly dispersed in water. Finally, a wet papermaking process was used to make sheets, and then, the product was pressed for 5 min under the pressure of 0.4 Mpa and dried for 5 min at 105° C., so that carbon nanotube/PI fiber paper was obtained.

0.035 g of nickel acetate, 0.005 g of cobalt acetate and 0.050 g of 2, 3, 6, 7, 10, 11-hexahydroxytriphenylene were added to 20 mL of water, followed by 10 cm×10 cm carbon nanotube/PI fiber paper (0.6 g), a reaction was carried out at 85° C. for 12 h, and then the product was washed and dried at 105° C. so as to obtain NiCo-CAT/carbon nanotube/PI fiber paper. At the room temperature, 4 mL of 20 g/L pyrrole aqueous solution was sprayed onto one side of the NiCo-CAT/carbon nanotube/PI fiber paper, and the fiber paper was allowed to stand still to react for 8 h. Finally, 5 mL of 100 g/L polyimide resin was used as spraying fluid to be sprayed onto the other side of the NiCo-CAT/carbon nanotube/PI fiber paper. After hot pressing was performed under the pressure of 10 Mpa for 10 min at the temperature of 130° C., a paper-based electromagnetic shielding composite with flame retardant properties was obtained.

Figure 4A:
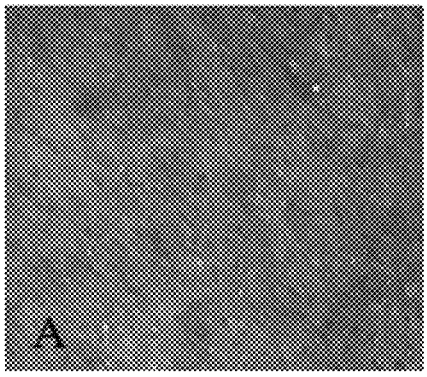
FIG. 4A is a physical diagram of the paper-based electromagnetic shielding composite before treatment in Example 1.
Figure 4B:
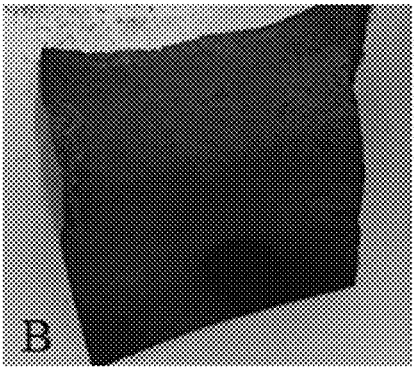
FIG. 4B is a physical diagram of the paper-based electromagnetic shielding composite after open flame treatment in Example 1.

After testing, the thickness, tensile strength, elongation at break, and surface electrical conductivity of the obtained paper-based electromagnetic shielding composite with flame retardant properties are 0.23 mm, 27.45 MPa, 1.95%, and 7.14 S/cm, respectively. The temperature thereof is 480° C. at 15% thermal weight loss. The electromagnetic interference shielding effectiveness ($SE_T$) thereof is 49.54-52.63 dB. The prepared paper-based electromagnetic shielding composite, after open flame treatment, still maintains the electromagnetic shielding effectiveness of over 80%, and can meet the electromagnetic shielding effectiveness requirements for commercial electromagnetic shielding paper (≥20 dB). In addition, the prepared paper-based electromagnetic shielding composite has a limit oxygen index greater than 41, which belongs to the material having a flame retardant grade of class 1. The physical diagrams of the paper-based electromagnetic shielding composite before and after open flame treatment are shown in FIG. 4A to FIG. 4B. FIG. 4A is a physical diagram of the paper-based electromagnetic shielding composite before the treatment. FIG. 4B is a physical diagram of the paper-based electromagnetic shielding composite after the open flame treatment. After the open flame treatment, most of the composite obtained in this example is still retained, and has excellent flame retardant effect.

Example 2

The mass ratio of the amount of the carbon nanotubes to the dopamine to the PI fibers in Example 1 was adjusted, and the other parameters were kept the same as those in Example 1, so that a paper-based electromagnetic shielding composite with flame retardant properties was obtained.

The performance of the obtained paper-based electromagnetic shielding composite with flame retardant properties was tested, and the test results were shown in Table 1. It can be seen from Table 1 that when the mass ratio of the amount of the carbon nanotubes to the dopamine hydrochloride to the PI fibers is 2:10:15 (in Example 1), the prepared paper-based electromagnetic shielding composite with flame retardant properties has better comprehensive performance in terms of mechanical properties, conductivity, temperature resistance, and electromagnetic shielding performance.

TABLE 1

Performance test results of paper-based electromagnetic shielding composites with flame retardant properties obtained by adding different amounts of carbon nanotubes

| The mass ratio of the amount of carbon nanotubes to dopamine hydrochloride to PI fibers | Flame retardant rating | Tensile strength (MPa) | Elongation at break (%) | Electrical conductivity (S/cm) | 15% thermal weight loss (° C.) | $SE_T$ (dB) |
|---|---|---|---|---|---|---|
| 2:10:15 (in Example 1) | 1 | 27.45 | 1.95 | 7.14 | 480 | 49.54-52.63 |
| 0.5:10:15 | 1 | 15.68 | 1.52 | 6.35 | 471 | 42.52-43.44 |
| 2:5:15 | 1 | 22.72 | 1.63 | 6.06 | 495 | 40.35-41.35 |

Example 3

The mass ratio of the 2, 3, 6, 7, 10, 11-hexahydroxytriphenylene to the dopamine to the PI fiber paper in Example 1 was adjusted, and the other parameters were kept the same as those in Example 1, so that a paper-based electromagnetic shielding composite with flame retardant properties was obtained.

The performance of the obtained paper-based electromagnetic shielding composite with flame retardant properties was tested, and the test results were shown in Table 2. It can be seen from Table 2 that when the mass ratio of the 2, 3, 6, 7, 10, 11-hexahydroxytriphenylene to the dopamine hydrochloride to the PI fiber paper is 1:40:12 (in Example 1), the prepared paper-based electromagnetic shielding composite with flame retardant properties has better comprehensive performance in terms of mechanical properties, conductivity, temperature resistance, and electromagnetic shielding performance.

TABLE 2

Performance test results of paper-based electromagnetic shielding composites with flame retardant properties obtained with different mass ratios of 2, 3, 6, 7, 10, 11-hexahydroxytriphenylene, dopamine, and carbon nanotube/PI fiber paper

| The mass ratio of 2, 3, 6, 7, 10, 11-hexahydroxy-triphenylene to dopamine hydrochloride to fiber paper | Flame retardant rating | Tensile strength (MPa) | Elongation at break (%) | Electrical conductivity (S/cm) | 15% thermal weight loss (° C.) | $SE_T$ (dB) |
|---|---|---|---|---|---|---|
| 1:40:12 (in Example 1) | 1 | 27.45 | 1.95 | 7.14 | 480 | 49.54-52.63 |
| 1:20:12 | 1 | 25.98 | 1.74 | 5.43 | 493 | 40.62-41.85 |
| 1:50:12 | 1 | 27.74 | 1.83 | 6.15 | 475 | 45.44-46.37 |

Example 4

The concentration of the polyimide resin in Example 1 was adjusted to 60 g/L, 80 g/L, and 120 g/L, and the other parameters were kept the same as those in Example 1, so that a paper-based electromagnetic shielding composite with flame retardant properties was obtained.

The performance of the obtained paper-based electromagnetic shielding composite with flame retardant properties was tested, and the test results were shown in Table 3. It can be seen from Table 3 that when the concentration of the polyimide resin is 100 g/L (in Example 1), the prepared paper-based electromagnetic shielding composite with flame retardant properties has better comprehensive performance in terms of mechanical properties, conductivity, temperature resistance, and electromagnetic shielding performance.

TABLE 3

Performance test results of paper-based electromagnetic shielding composites with flame retardant properties obtained by spraying with different concentrations of polyimide resin

| The concentration of polyimide resin (g/L) | Flame retardant rating | Tensile strength (MPa) | Elongation at break (%) | Electrical conductivity (S/cm) | 15% thermal weight loss (° C.) | $SE_T$ (dB) |
|---|---|---|---|---|---|---|
| 100 (in Example 1) | 1 | 27.45 | 1.95 | 7.14 | 480 | 49.54-52.63 |
| 60 | 1 | 16.53 | 0.86 | 7.23 | 505 | 52.71-53.64 |
| 80 | 1 | 24.24 | 1.45 | 7.15 | 475 | 50.26-51.75 |
| 120 | 1 | 30.54 | 2.28 | 6.72 | 465 | 40.35-41.63 |

Comparative Example 1

3.0 g of PI fibers were evenly dispersed in water, and 2.0 g of dopamine hydrochloride and 2.4 g of tris(hydroxymethyl) aminomethane were then added to react for 6 h at the room temperature. After the reaction was finished, 0.4 g of carbon nanotubes was added, and stirring was continued to react for 12 h. Finally, the product was filtered, washed, and dried at 105° C., so that carbon nanotube-modified PI fibers were obtained. 1.32 g of the modified PI fibers and 0.56 g of PPTA pulp were evenly dispersed in water. Finally, a wet papermaking process was used to make sheets, and then, the product was pressed for 5 min under the pressure of 0.4 Mpa and dried for 5 min at 105° C., so that carbon nanotube/PI fiber paper (with a basis weight of 60 g/cm$^2$) was obtained. At the room temperature, 4 mL of 20 g/L pyrrole aqueous solution was sprayed onto one side of the carbon nanotube/PI fiber paper, and the fiber paper was allowed to stand still to react for 8 h. Finally, 5 mL of 100 g/L polyimide resin was used as spraying fluid to be sprayed onto the other side of the carbon nanotube/PI fiber paper. After hot pressing was performed under the pressure of 10 Mpa for 10 min at the temperature of 130° C., composite fiber paper was obtained.

The tensile strength of the composite fiber paper (unmodified MOF) obtained in this Comparative Example 1 is 24.30 MPa. The temperature thereof is 495° C. at 10% thermal weight loss. The electrical conductivity thereof is 5.41 S/cm. The electromagnetic shielding effectiveness thereof in the entire X-band is 32.55-34.63 dB.

Comparative Example 2

1.32 g of PI fibers and 0.56 g of PPTA pulp (the ratio of the PI fibers to the PPTA pulp is equal to 7:3) were dispersed in 400 g of water and stirred for 5 min, and sheet making was performed on a paper sample sheet machine. Then, the product was pressed for 5 min under the pressure of 0.4 Mpa and dried for 5 min at 105° C., so that PI fiber paper (with a basis weight of 60 g/cm$^2$) was obtained.

0.035 g of nickel acetate, 0.005 g of cobalt acetate and 0.05 g of 2, 3, 6, 7, 10, 11-hexahydroxytriphenylene were added to 20 mL of water, followed by 10 cm×10 cm PI fiber paper (0.6 g), a reaction was carried out at 85° C. for 12 h, and then the product was washed and dried at 105° C. so as to obtain NiCo-CAT/PI fiber paper. At the room temperature, 4 mL of 20 g/L pyrrole aqueous solution was sprayed onto one side of the NiCo-CAT/PI fiber paper, and the fiber paper was allowed to stand still to react for 8 h. Finally, 5 mL of 100 g/L polyimide resin was used as spraying fluid to be sprayed onto the other side of the NiCo-CAT/PI fiber paper. After hot pressing was performed under the pressure of 10 Mpa for 10 min at the temperature of 130° C., composite fiber paper was obtained.

The tensile strength of the composite fiber paper (modified carbon nanotubes) obtained in this Comparative Example 2 is 23.24 MPa. The temperature thereof is 502° C. at 10% thermal weight loss. The electrical conductivity thereof is 6.28 S/cm. The electromagnetic shielding effectiveness thereof in the entire X-band is 43.25-45.63 dB.

Comparative Example 3

3.0 g of PI fibers were evenly dispersed in water, and 2.0 g of dopamine hydrochloride and 2.4 g of tris(hydroxymethyl) aminomethane were then added to react for 6 h at the room temperature. After the reaction was finished, 0.4 g of carbon nanotubes was added, and stirring was continued to react for 12 h. Finally, the product was filtered, washed, and dried at 105° C., so that carbon nanotube-modified PI fibers were obtained. 1.32 g of the modified PI fibers and 0.56 g of PPTA pulp were evenly dispersed in water. Finally, a wet papermaking process was used to make sheets, and then, the product was pressed for 5 min under the pressure of 0.4 Mpa and dried for 5 min at 105° C., so that carbon nanotube/PI fiber paper (with a basis weight of 60 g/cm$^2$) was obtained.

0.035 g of nickel acetate, 0.005 g of cobalt acetate and 0.05 g of 2, 3, 6, 7, 10, 11-hexahydroxytriphenylene were added to 20 mL of water, followed by 10 cm×10 cm carbon nanotube/PI fiber paper (0.6 g), a reaction was carried out at 85° C. for 12 h, and then the product was washed and dried at 105° C. so as to obtain NiCo-CAT/carbon nanotube/PI fiber paper. Then, 5 mL of 100 g/L polyimide resin was used as spraying fluid to be sprayed onto the other side of the NiCo-CAT/carbon nanotube/PI fiber paper. After hot pressing was performed under the pressure of 10 Mpa for 10 min at the temperature of 130° C., composite fiber paper was obtained.

The composite fiber paper (unmodified polypyrrole) obtained in Comparative Example 3 was tested for its flame retardant rating, mechanical properties, electrical conductivity, thermogravimetric property and electromagnetic shielding performance, and the obtained results were shown in Table 4.

It can be seen from Tables 1-4:

According to the present disclosure, the prepared paper-based electromagnetic shielding composite with flame retardant rating can reach the flame retardant grade of class 1. The tensile strength, elongation at break, and surface electrical conductivity of the paper-based electromagnetic shielding composite obtained in Example 1 are 27.45 MPa, 1.95%, and 7.14 S/cm, respectively. The temperature thereof is 480° C. at 15% thermal weight loss. The electromagnetic interference shielding effectiveness ($SE_T$) thereof is 49.54-52.63 dB. In addition, the prepared paper-based electromagnetic shielding composite, after open flame treatment, still maintains the electromagnetic shielding effectiveness of over 80%, and can meet the electromagnetic shielding effectiveness requirements for commercial electromagnetic shielding paper (≥20 dB). The prepared paper-based electromagnetic shielding composite has a limit oxygen index greater than 41, which belongs to the material having a flame retardant grade of class 1, has excellent comprehensive performance, and is wider in application range.

Although the present disclosure has been disclosed above with exemplary examples, it is not intended to limit the present disclosure. Those familiar with this technology can make various changes and modifications without departing from the technology and scope of the present disclosure. Therefore, the protection scope of the present disclosure should be defined by the Claims.

What is claimed is:

1. A method for preparing a paper-based electromagnetic shielding composite with flame retardant properties, comprising the following steps:

(1) dispersing polyimide (PI) fibers in water, adding dopamine hydrochloride and tris(hydroxymethyl) aminomethane to react, and then adding carbon nanotubes to continue the reaction; after the reaction is finished, filtering and collecting solids, washing, and drying to obtain carbon nanotube-modified PI fibers, denoted as carbon nanotube/PI fibers;

(2) dispersing the carbon nanotube-modified PI fibers and PPTA pulp in water, mixing well, and then using a wet papermaking process to make sheets; after that, pressing and drying to obtain carbon nanotube/PI fiber paper;

(3) dispersing a nickel source, a cobalt source and 2, 3, 6, 7, 10, 11-hexahydroxytriphenylene in water, then adding the obtained carbon nanotube/PI fiber paper, and carrying out a reaction at 70-100° C.; after the reaction is finished, taking out the carbon nanotube/PI fiber paper, and drying to obtain MOFs-modified carbon

TABLE 4

Product performance test results obtained in Comparative Examples 1-3

| The concentration of polyimide resin (g/L) | Flame retardant rating | Tensile strength (MPa) | Elongation at break (%) | Electrical conductivity (S/cm) | 15% thermal weight loss (° C.) | $SE_T$ (dB) |
|---|---|---|---|---|---|---|
| Example 1 | 1 | 27.45 | 1.95 | 7.14 | 480 | 49.54-52.63 |
| Comparative Example 1 | 1 | 24.30 | 1.63 | 5.41 | 495 | 32.55-34.63 |
| Comparative Example 2 | 1 | 23.24 | 1.45 | 6.28 | 502 | 43.25-45.63 |
| Comparative Example 3 | 1 | 16.50 | 1.08 | 3.22 | 510 | 23.42-24.87 |

nanotube/PI fiber paper, denoted as NiCo-CAT/carbon nanotube/PI fiber paper; and (4) spraying one side of the obtained NiCo-CAT/carbon nanotube/PI fiber paper with a pyrrole solution and keeping it to stand still for a reaction; and after the reaction is finished, spraying a polyimide resin solution onto the other side of the NiCo-CAT/carbon nanotube/PI fiber paper, and then performing hot-pressing treatment to obtain the paper-based electromagnetic shielding composite with flame retardant properties.

2. The method according to claim 1, wherein in step (1), the mass ratio of the dopamine hydrochloride to the tris (hydroxymethyl) aminomethane to the carbon nanotubes to the PI fibers to the water is (2-6):(3-6):(0.1-0.5):3:1000, respectively.

3. The method according to claim 1, wherein in step (1), the mass ratio of the carbon nanotubes to the dopamine hydrochloride to the PI fibers is (0.5-2):(5-10):15.

4. The method according to claim 1, wherein in step (2), the mass ratio of the carbon nanotube-modified PI fibers to the PPTA pulp is (6-8):(2-4).

5. The method according to claim 1, wherein in step (3), the mass ratio of the 2, 3, 6, 7, 10, 11-hexahydroxytriphenylene to the dopamine hydrochloride to the carbon nanotube/PI fiber paper is 1:(20-50):12.

6. The method according to claim 1, wherein in step (4), the concentration of the polyimide resin solution is 50-150 g/L.

7. The method according to claim 1, wherein in step (4), the concentration of the pyrrole aqueous solution is 10-30 g/L.

* * * * *